US006309142B1

(12) United States Patent
Takeda et al.

(10) Patent No.: US 6,309,142 B1
(45) Date of Patent: Oct. 30, 2001

(54) STRUCTURE FOR PREVENTING FROST HEAVE DAMAGE TO AN UNDERGROUND STRUCTURE AND A METHOD OF INSTALLING THE SAME

(75) Inventors: Kazuo Takeda; Akihiko Okamura; Juichi Nakazawa; Akiyoshi Otobe, all of Osaka (JP)

(73) Assignee: Konoike Construction Co., Ltd., Osaka (JP)

( * ) Notice: Subject to any disclaimer, the term of this patent is extended or adjusted under 35 U.S.C. 154(b) by 545 days.

(21) Appl. No.: 08/836,892

(22) PCT Filed: Sep. 19, 1996

(86) PCT No.: PCT/JP96/02695

§ 371 Date: May 22, 1997

§ 102(e) Date: May 22, 1997

(87) PCT Pub. No.: WO97/11232

PCT Pub. Date: Mar. 27, 1997

(30) Foreign Application Priority Data

Sep. 22, 1995 (JP) ..... 7-269078

(51) Int. Cl.[7] ..... E02D 5/22

(52) U.S. Cl. ..... 405/231; 405/229; 405/232; 405/234; 405/243; 405/258

(58) Field of Search ..... 405/229, 216, 405/258, 154, 157, 231, 234, 243, 244, 232

(56) References Cited

U.S. PATENT DOCUMENTS

| | | | | |
|---|---|---|---|---|
| 951,668 | * | 3/1910 | Welsh | 405/243 |
| 1,742,926 | * | 1/1930 | Newton | 405/243 |
| 3,090,204 | * | 5/1963 | UpOson | 405/243 |
| 3,198,857 | * | 8/1965 | Childers et al. | 405/243 X |
| 3,217,791 | * | 11/1965 | Long | 405/234 X |
| 3,706,204 | * | 12/1972 | Long | 405/234 X |
| 4,067,198 | * | 1/1978 | Long | 405/234 X |
| 4,813,816 | * | 3/1989 | Simanjuntak | 405/244 |
| 4,818,148 | * | 4/1989 | Takeda et al. | 405/234 |
| 5,106,231 | * | 4/1992 | Thomann | 405/119 |
| 5,108,227 | * | 4/1992 | Bergey | 405/231 X |

FOREIGN PATENT DOCUMENTS

| | | | | |
|---|---|---|---|---|
| 0258256 | * | 7/1988 | (DE) | 405/244 |
| 989975 | * | 5/1951 | (FR) | 405/244 |
| 0085036 | * | 5/1984 | (JP) | 405/234 |
| 0765456 | * | 9/1980 | (SU) | 405/234 |

* cited by examiner

*Primary Examiner*—David Bagnell
*Assistant Examiner*—Jong-Suk Lee
(74) *Attorney, Agent, or Firm*—Wenderoth, Lind & Ponack L.L.P.

(57) ABSTRACT

A durable frost heave damage preventive structure of underground structures applicable easily and at low cost to many different kinds of underground structures. The frost heave damage preventive structure includes a plate-like reaction member (7) provided at the bottom of an underground structure (1) approximately in parallel to a freezing front in the ground.

9 Claims, 7 Drawing Sheets

STRUCTURE FOR PREVENTING FROST HEAVE DAMAGE TO AN UNDERGROUND STRUCTURE AND A METHOD OF INSTALLING THE SAME

BACKGROUND OF THE INVENTION

1. Field of the Invention

The present invention relates to underground structures such as protective grids, a ground structure foundation such as a pile foundation for a pipeline and a pile foundation of a building, etc., pipes buried in a vertical direction such as a water pipe, gas pipe, etc., a drainage channel structure such as a U-shaped ditch, etc. a manhole, an underground storage chamber, an underground storage tank, a basement of a building, etc. and other underground structures (hereinafter simply referred to as "underground structures") constructed in cold regions and, more specifically, a frost heave damage preventive structure of underground structures constructed in a manner so as to protect the underground structure against frost heave and thaw settlement.

2. Background of the Invention

Underground structures constructed in cold regions suffer from damage due to frost heave such as floating and jetting from the surface of the ground, getting broken, etc. by being repeatedly subject to the actions of frost heave and thaw settlement.

The principle of frost heave of underground structures due to this frost heave and thaw settlement will be explained first by taking the protective grid member 1 (hereinafter simply referred to as "protective grid") indicated in FIG. 1 as an example.

As shown in FIG. 1(*a*), a protective grid 1 buried under the ground (unfrozen soil layer 3) is lifted with frost heave of the soil which is frozen on the side face of the portion included in the frozen soil layer 4 of the protective grid 1 as shown in FIG. 1(*b*), and the protective grid 1 moves in the unfrozen soil layer 3, as the atmospheric temperature decreases, freezing the soil and causing frost heave. As a result, a cavity 6 is formed under the bottom face of the protective grid 1.

In FIG. 1(*b*), reference numeral 2' indicates the position of the ground surface before frost heaving of the soil, reference numeral 4 indicates the frozen soil layer, and reference numeral 5 indicates the freezing front (border between unfrozen soil layer 3 and frozen soil layer 4), respectively.

Although the soil around the cavity 6 is not frozen at least at this point in time, the cavity 6 changes in shape and gets smaller under the influence of freezing and thawing action, soil pressure, etc. with the passage of time.

Also, even if the surface of the ground 2 returns to its initial position as the atmospheric temperature increases and the soil settles with thawing, the protective grid 1 cannot return to the original position because of the change in the shape of the cavity 6 and therefore remains heaved on the ground surface 2.

Moreover, this floating accumulates because the protective grid 1 is repeatedly subject to frost action such as frost heave, thaw settlement of frozen soil and, eventually, the protective grid 1 gets in a state in which it protrudes from the surface of the ground 2 as shown in FIG. 1(*d*). For that reason and also because the amount of frost heave varies from place to place, the protective grid 1 is likely to deform and break. As a result, the protective grid 1 can no longer perform its intended function, which presents a risk of collapse of the face of a slope if combined with other factors such as precipitation, etc.

By the way, it is known that damage by frost heave occurs, not only to underground structures buried in comparatively shallow positions under the ground such as the protective grid 1, but also to underground structures buried in comparatively deep positions under the ground, such as the foundation of a ground structure such as a pile foundation of a pipeline, a pile foundation of a building, etc. The principle of such damage will be explained by reference to the pile foundation 10 (hereinafter referred to simply as "pile" in some cases) indicated in FIG. 4 as an example.

As shown in FIG. 4, a pile 10 buried under the ground is subject to a an upward frost heaving force F produced at the freezing front 5, through the frozen soil layer 4, in a narrow freezing part near the 0° C. isotherm around the pile 10 when the atmospheric temperature decreases, causing freezing and frost heave of the soil. The range of the freezing front 5 in which the frost heaving force acts on the pile 10 (force acting in a way to lift the pile 10) depends on the deforming capacity of the frozen soil layer 4.

On the other hand, forces resisting this frost heaving force are the weight W of the pile itself (dead weight), the weight W of the ground structure (not illustrated) supported by the pile 10, and the frictional force with the unfrozen soil layer 3 around the pile 10.

Also, when the balance between the frost heaving force lifting the pile 10 and the forces resisting this frost heaving force is lost and the frost heaving force lifting the pile 10 becomes larger than the latter, the pile 10 is lifted due to frost heave of the soil, thereby causing substantial damage to the ground structure.

In order to protect underground structures from damage caused by frost heave and thaw settlement, various methods for increasing the frictional force resisting the frost heaving force have been proposed and implemented such as 1) replacing the soil around the underground structure with soil or material not easily frost heaved, 2) lessening the amount of lift due to freezing of soil by increasing the dead weight of the underground structure, 3) increasing the peripheral friction by increasing the buried depth of the underground structure, 4) forming the peripheral face in a special shape such as a wave shape, etc. to increase the friction against upward movement so as to lessen the amount of lift due to freezing of soil, 5) preventing adfreezing of soil by forming a sliding layer or an insulating layer around the underground structure, 6) burying the pile as heat pipe pile to form a frozen soil layer under the pile with the cold heat during the winter season or 7) fixing the pile to the permafrost, etc.

However, these methods had problems such as impossibility of perfectly preventing frost heave of an underground structure, difficulty of obtaining soil or material not easily frost heaved, high costs, restriction to applicable types of underground structures, drop of a protective effect against frost heave damage, etc.

SUMMARY OF THE INVENTION

The object of the present invention is to provide a durable frost heave damage preventive structure for underground structures which is applicable easily and at a low cost to many different kinds of underground structures and its method of installation, in view of the problems of conventional frost heave damage preventive structures of underground structures.

To achieve the objective, the frost heave damage preventive structure for underground structures according to the present invention is characterized in that a plate-like reaction member is provided at the bottom or lower portion of the underground structure approximately in parallel with the freezing front (approximately in parallel with the ground surface in the case of an ordinary homogenous soil layer).

In this way, it becomes possible to effectively prevent damage due to frost heave of underground structures with an extremely simple structure which includes a plate-like reaction member at the bottom or lower portion of the underground structure approximately in parallel with the freezing front. For that reason, this frost heave damage preventive structure is widely applicable to many different kinds of underground structures and can protect underground structures from frost heave easily and economically even by using frost-susceptible soil produced on the site for backfilling of the underground structure when non frost-susceptible soil is difficult to obtain. The frost heave damage preventing structure is also very durable.

In this case, the reaction member can be provided in a position either shallower or deeper than the maximum frost depth depending on the type of underground structure, and the position of the reaction member may be set for the lower end or any desired intermediate point of the underground structure. Also, a plural number of reaction members may also be provided as required in an approximately parallel orientation with respect to the freezing front.

The maximum value of the frost depth as mentioned here refers to the value that may be produced within a certain period at the place of construction of the underground structure, and the maximum depth of the layer in which frost heave and thaw settlement of the soil are repeated.

In the case where the underground structure is installed at a position shallower than the maximum freezing depth and therefore the reaction member is provided at a position shallower than the maximum freezing depth, it is possible to effectively prevent floating from the ground surface due to frost heave of an underground structure by preventing lifting of the underground structure when the freezing front is found at a position shallower than the reaction member, and by lifting the underground structure and the reaction member together with the soil around them when the freezing front is found at a position deeper than the reaction member.

On the other hand, in the case where the underground structure is installed at a position deeper than the maximum value of frost depth and therefore the reaction member is provided at a position deeper than the maximum value of frost depth, it is possible to effectively prevent frost heave of the underground structure by arranging in such a way that the freezing front may always be at a position shallower than that of the reaction member and thus perfectly preventing lifting of the underground structure with a reaction of the reaction member.

Moreover, the frost heave damage preventive structure of underground structures according to the present invention is applicable to many different kinds of underground structures such as protective grids, foundations of ground structures such as a pile foundation of a pipeline and a pile foundation of a building, etc., pipes buried in a vertical direction such as a water pipe, a gas pipe, etc., a drainage channel structure such as a U-shaped ditch, etc. a manhole, an underground storage chamber, an underground storage tank, a basement of a building, etc. and other underground structures (hereinafter simply referred to as "ground structures") constructed in cold regions. More specifically, a frost heave damage preventive structure for underground structures that is realized in a way to protect underground structures against frost heave and thaw settlement, and can effectively protect various kinds of underground structure against frost heave.

In this case, the piles such as pile foundations for a pipeline and pile foundation of a building, etc. can be installed by excavating pile holes larger than the plane shape of the reaction member up to the planned buried position of the reaction member, installing piles provided with a reaction member on a side face in the pile holes, and back filling the void above the reaction member.

DETAILED DESCRIPTION OF THE INVENTION

Figure 1A:
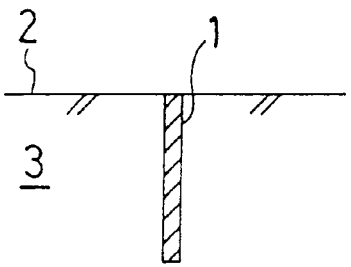
FIGS. 1(*a*)–(*d*) are schematic drawings explaining the principle of frost heave of an underground structure by frost heave and thaw settlement.
Figure 1B:
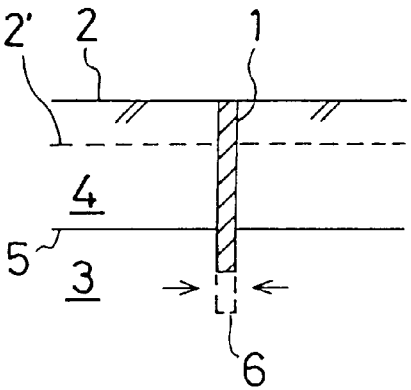
Figure 1C:
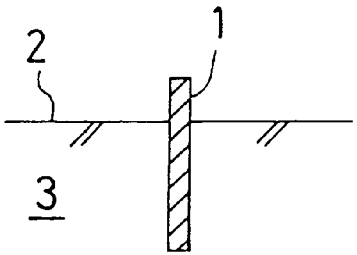
Figure 1D:
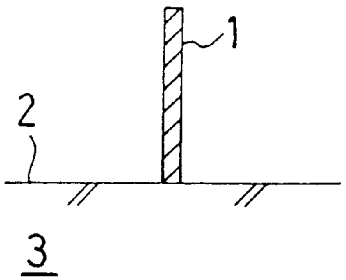
Figure 2A:
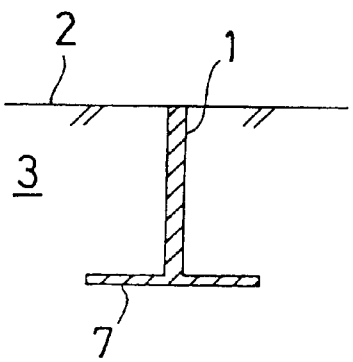
FIGS. 2(*a*)–(*d*) are explanatory drawings of the principle of prevention of frost heave damage by a frost heave damage preventive structure for underground structures according to the present invention.
Figure 2B:
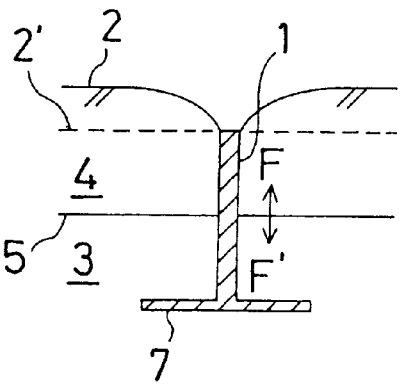
Figure 2C:
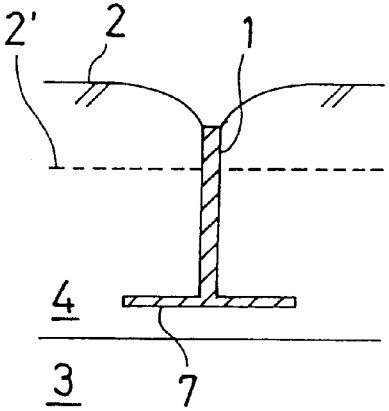
Figure 2D:
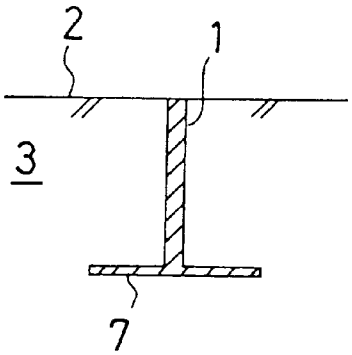

Initially, the principle of prevention of frost heave damage by a frost heave damage structure for underground structures according to the present invention will be explained by taking the protective grid member 1 indicated in FIG. 2 as an example.

As shown in FIG. 2(*a*), the protective grid 1 is buried under the ground (unfrozen soil layer 3) approximately vertically, and to the grid bottom end is fixed a plate-like reaction member 7. The reaction member 7 is positioned in parallel with the ground surface 2 so as to be approximately parallel to the freezing front 5 to be described later.

As the atmospheric temperature, decreases, the soil starts freezing from the ground surface 2. Assuming that the ground surface conditions, atmospheric conditions, soil conditions, conditions of underground water, etc. are uniform, the freezing range of soil generally expands approximately in parallel to the ground surface.

The frozen portion of the ground will be indicated as frozen soil layer 4, the unfrozen portion of the ground as unfrozen soil layer 3, the border layer between the two as freezing front 5 and the position of ground surface before freezing of the soil as 2'.

Frost heave is produced as ice lens grows while absorbing water from the unfrozen soil layer 3 in the negative temperature area in the immediate proximity of the freezing front 5. A frost heaving force develops on the growing surface of ice lens in the neighborhood of the freezing front 5 if any force acts which restricts expansion of water due to growth of ice lens. Also, generally, frost heave and thaw settlement are repeated within a certain period of time.

If, when the soil freezes and frost heave is produced, the freezing front 5 is higher than the top face of the reaction member 7 of the protective grid 1, the protective grid 1 is subject, through the frozen soil layer 4, to the frost heaving force F (upward force) produced on the freezing front 5 in a certain range around the protective grid 1 as the soil is frozen on the side face of the portion included in the frozen soil layer 4 of the protective grid 1 as shown in FIG. 2. The range of the freezing front 5 in which the frost heaving force acts on the protective grid 1 is influenced by the deforming capacity of the frozen soil layer 4. On the other hand, the reaction member 7 is subject, through the unfrozen soil layer 3 around the protective grids 1, to a frost heaving reaction force F' (frost heaving force F and frost heaving reaction force F' per unit surface area are forces of identical strength) from the freezing front 5 and the dead weight of the frozen soil layer 4 and the unfrozen soil layer 3 on the reaction member 7. This frost heaving reaction force F' is transmitted to the protective grid 1 through the reaction member 7.

As a result, the frost heaving force F acting on the protective grid 1 from the frozen soil layer 4 is balanced, inside the protective grid 1, with the frost heaving reaction force F' acting on the protective grid 1 from the unfrozen soil layer 3 through the reaction member 7, without producing any frost heave of the protective grid 1 or movement of protective grid 1 in the unfrozen soil layer 3, thus preventing formation of any cavity under the reaction member 7.

Next, a case will be considered where the freezing front 5 is found on the side face of the reaction member 7.

If the reaction member 7 is formed with a member having a fairly large thickness, it takes some time for the freezing front 5 progressing in about parallel to the ground surface 2 to pass through the thickness of the reaction member 7 and, during this time, the protective grid 1 frost heaves to form a cavity under the reaction member 7 by the principle of freezing and frost heave illustrated in FIG. 1. As a result, the protective grid 1 floats from the ground surface.

However, in the case where the reaction member 7 is formed by keeping at least the thickness of the outer end to a negligible level, only a very short time is enough for the freezing front 5 to pass through the thickness of this reaction member 7, and no problematic cavity is produced under the reaction member 7 by freezing and frost heave during that time.

Also, as the atmospheric temperature further decreases, the freezing of the soil progresses and the freezing front 5 reaches a position deeper than the position of the reaction member 7, the protective grid 1 and the reaction member 7 are integrated with the frozen soil layer 4, as shown in FIG. 2(*c*), and the entire frozen soil layer 4 heaves with freezing of the soil. At that time, the protective grid 1 does not form any cavity in the unfrozen soil layer 3.

By the way, if the ground surface 2 returns to its original position from the state of either FIG. 2(*b*) or FIG. 2(*c*) due to an increase of atmospheric temperature and thaw settlement of the soil, the protective grid 1 also returns to its original position (same position as that shown in FIG. 2(*a*)), as shown in FIG. 2(*d*). For that reason, no cavity is formed in the unfrozen soil layer 3 even with repeated actions due to frost heave and thaw settlement of the soil and, therefore, the protective grid 1 does not remain heaved nor does it protrude from the ground surface 2 or is it broken.

In that case, as it is apparent also from the principle of prevention of frost heave damage, the plate-like reaction member provided at the bottom of the underground structure must have a surface area sufficiently large for supporting the reaction corresponding to the frost heaving force exerted on the underground structure. Moreover, it is also necessary for the strength of the underground structure and the reaction member as well as the fixing strength between the underground structure and the reaction member to be sufficiently large for resisting the frost heaving force of the frozen soil layer.

Next, explanation will be made on the principle of prevention of frost heave damage by the frost heave damage preventive structure of the underground structure according to the present invention by taking the pile 10 indicated in FIG. 5 as an example. The principle of freezing of soil is the same as that in the above example.

Figure 5:
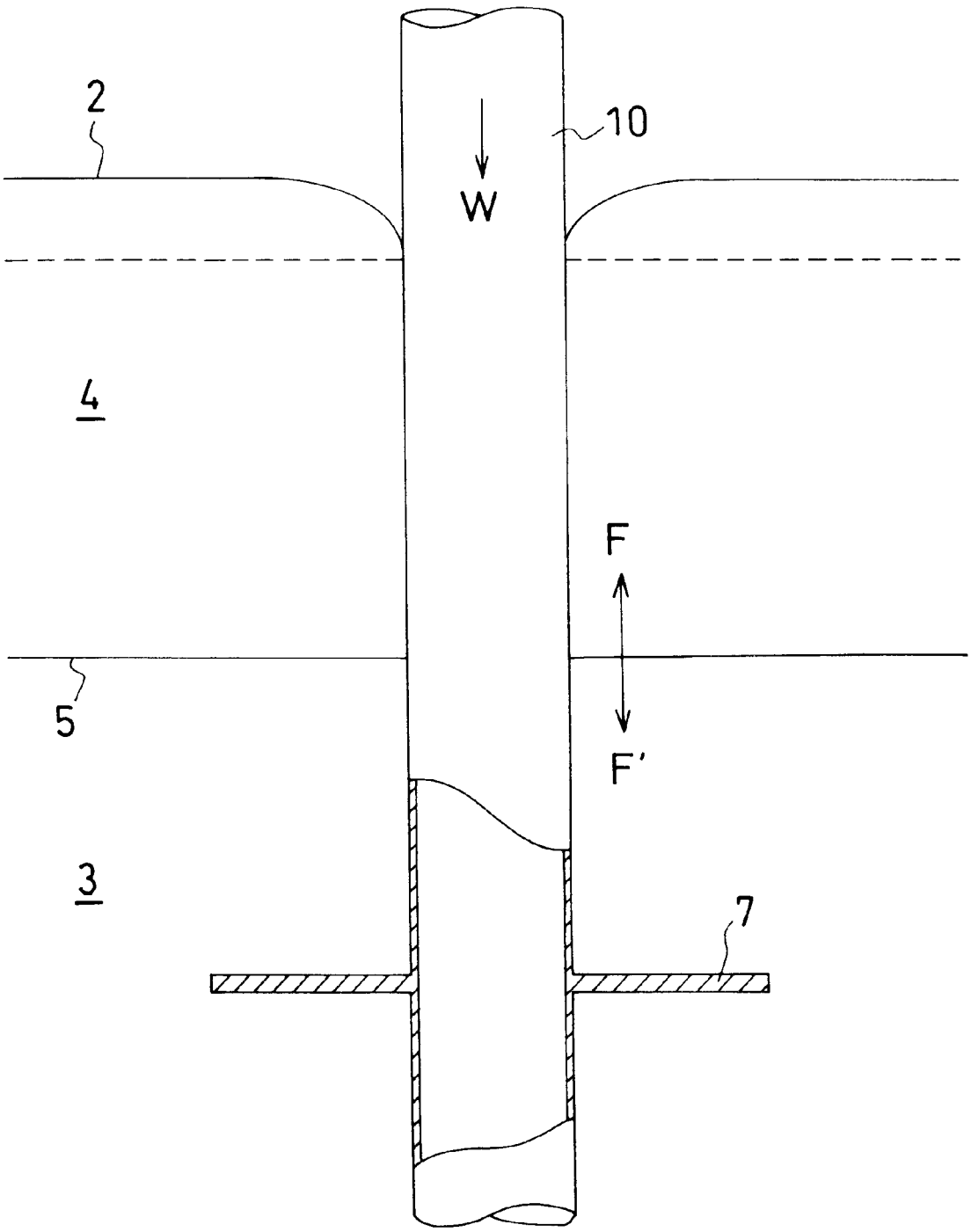
FIG. 5 is a schematic drawing of the principle of prevention of frost heave damage by a frost heave damage preventive structure of an underground structure according to the present invention.

As shown in FIG. 5, the pile 10 is buried approximately in a vertical orientation, and at its intermediate position is fixed a disc-shaped reaction member 7 which is approximately parallel with respect to the ground surface 2, so as to be approximately parallel to the freezing front 5 to be described later.

As the atmospheric temperature decreases, the soil starts freezing from the ground surface 2.

When the soil freezes and frost heave is produced, the pile 10 buried under the ground is subject, through the frozen soil layer 4, to the frost heaving force F (upward force) produced on the freezing front 5 in a certain range around the pile 10 as the soil is frozen on the side face of the portion included in the frozen soil layer 4 of the pile 10. The range of the freezing front 5 in which the frost heaving force (force acting in a way to lift the pile 10) acts on the pile 10 is influenced by the deforming capacity of the frozen soil layer 4.

On the other hand, forces resisting this frost heaving force are the weight W of the pile itself (dead weight), the weight W of the ground structure (not illustrated) which is supported by the pile 10 and the frictional force with the unfrozen soil layer 3 around the pile 10. Moreover, since the reaction member 7 is subject, through the unfrozen soil layer 3 around the pile 10, to a frost heaving reaction force F' (frost heaving force F and frost heaving reaction force F' per unit surface area are forces of identical strength) from the freezing front 5 and the dead weight of the frozen soil layer 4 and the unfrozen soil layer 3 on the reaction member 7, this reaction force of frost heave F' acts on the pile 10 through the reaction member 7 as a resisting force to the frost heaving force acting in a way to lift the pile 10.

As a result, the frost heaving force F acting on the pile 10 from the frozen soil layer 4 is balanced, inside the pile 10, with the frost heaving reaction force F' acting on the protective grids 1 from the unfrozen soil layer 3 through the reaction member 7. Namely, by installing the reaction member 7 at a position deeper than the maximum freezing depth, it becomes possible to completely prevent lifting of the pile 10 by the above-mentioned principle.

The size of the reaction member 7 fixed at intermediate position of the pile 10 shall preferably be set to a size that is sufficient for covering the range of the freezing front 5 (this range is variable with the deforming capacity of the frozen soil layer 4) in which the frost heaving force (force acting in a way to lift the pile 10) acts on the pile.

The preferred embodiment of the frost heave damage preventive structure for underground structures according to the present invention will be explained hereafter by taking a protective grid and a water pipe as examples.

Figure 3A:
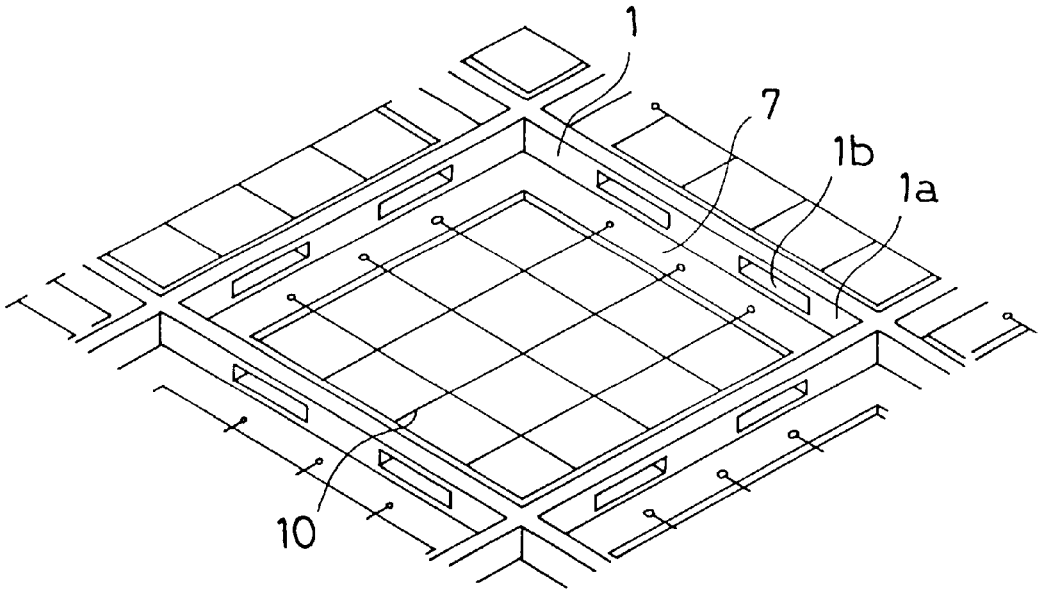
FIGS. 3(*a*)–(*b*) are drawings illustrating an example of an application to protective grids of a frost heave damage preventive structure for an underground structures according to the present invention.
Figure 3B:
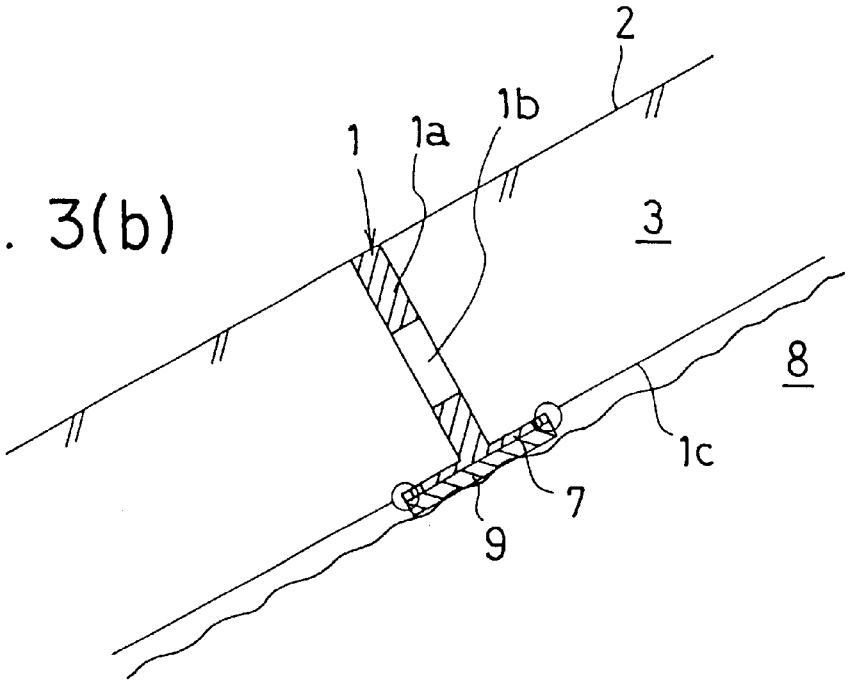
Figure 4:
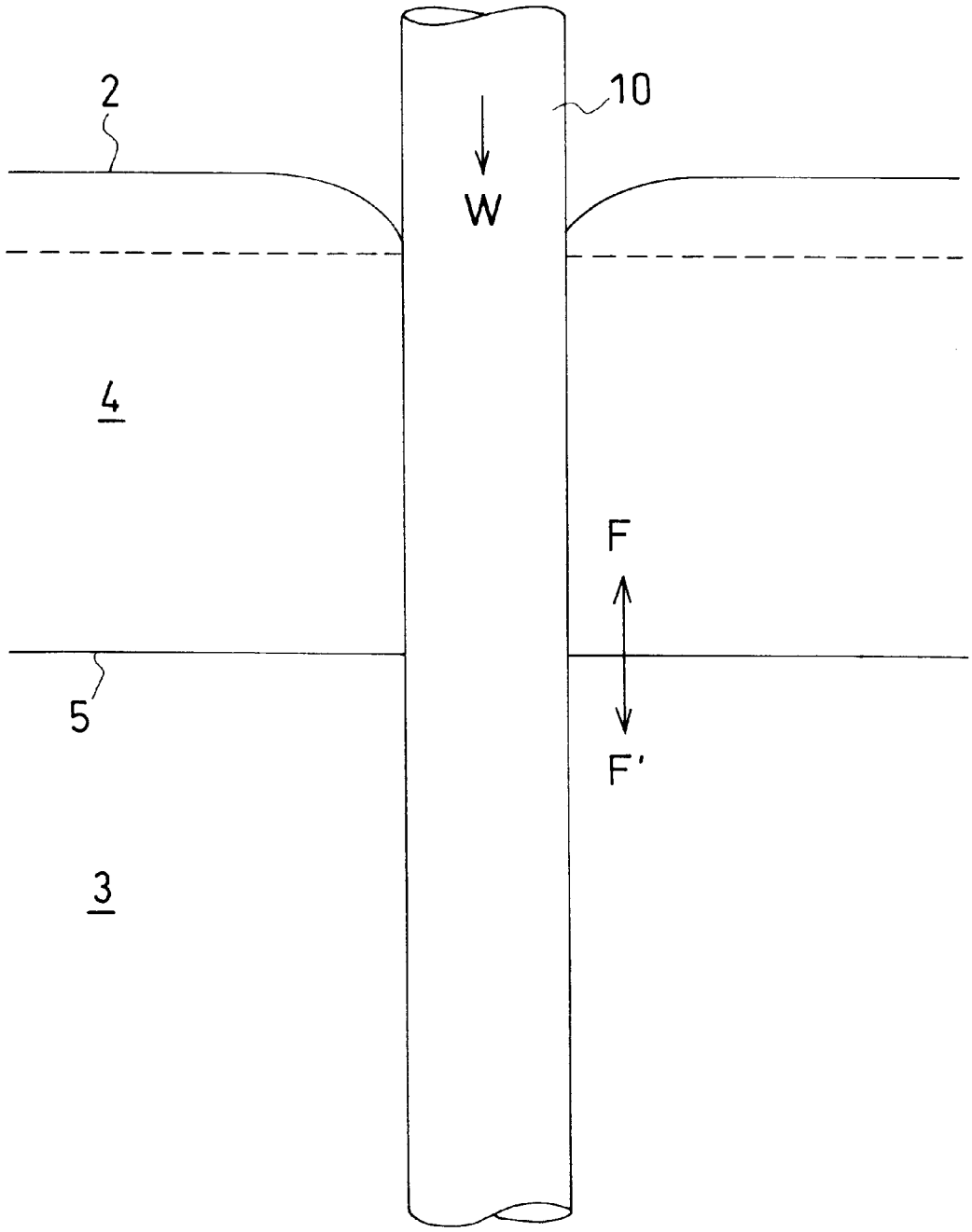
FIG. 4 is an explanatory drawing of the principle of frost heave of an underground structure by frost heave and thaw settlement.

FIGS. 2(*a*)–(*d*) and FIGS. 3(*a*)–(*b*) show examples in which the frost heave damage preventive structure for underground structures according to the present invention is applied to a protective grid.

The protective grid 1 is realized by integrally forming a plate-like reaction member 7 (thickness: 3 mm, width: 130 mm) at the lower part of a square-shaped protective grid body 1*a* (thickness: 30 mm, width in direction of width: 150 mm, length of one side: 1 m). In this case, it is desirable to form a through hole 1*b* in the protective grid body 1*a* to help grow the rhizome of plants such as dwarf bamboo, etc. growing on the slope on which are installed the protective grids 1, and to install a reinforcing bar mesh 1*c* to make it easy to bear the reaction force from the frozen soil layer acting on the unfrozen soil layer around the protective grids 1 and the weight of the soil. The specific shape and dimensions of the protective grids are not limited to those indicated above but may be determined according to the state of the slope on which the protective grids 1 are installed, etc.

The protective grids 1 may be made of metal such as iron, stainless steel, aluminum, etc. or any material which is conventionally used for protective grids such as concrete, synthetic resin, timber, etc.

In that case, it is possible to use different component materials for the protective grid body 1*a* and the reaction member 7, such as timber for the protective grid body 1*a* and a metallic material such as iron sheet, etc. for the reaction member 7.

Moreover, the binding means between protective grid body 1*a* and reaction member 7 may be integrated molding, welding, bonding, or fastening by bolts & nuts, etc. depending on the material of the protective grids 1.

Furthermore, it is also possible to form a reinforcing rib, for reinforcing the reaction member 7, extending over the reaction member 7 to the protective grid body 1*a*.

In the case where the protective grids 1 are installed on a soft rock face 8, for example, where the shaping of slope is difficult, it will be possible, if there is any gap between the trimmed surface of soft rock 8 and the reaction member 7, to pack an elastic back-filling material 9 consisting of porous foamed resin, etc. in the gap and then pack a proper kind of soil 3 such as locally produced soil, etc. in the space partitioned by the protective grid body 1*a*.

In that case, the soil 3 will be packed at a uniform thickness over the reaction member 7.

As indicated in the explanation of the principle of frost heave damage prevention, lifting of the protective grids 1 can be prevented due to an action of the reaction member 7 when the freezing front is found at a position shallower than the reaction member. Moreover, when the freezing front is found at a position deeper than the reaction member 7, it is possible to prevent the grids 1 from remaining or protruding from the ground surface 2 or breaking even with repeated actions of frost heave and thaw settlement of the soil, by lifting the underground structure and the reaction member 7 together with the soil 3 around them.

Figures 6A, 6B, 6C, 6D:
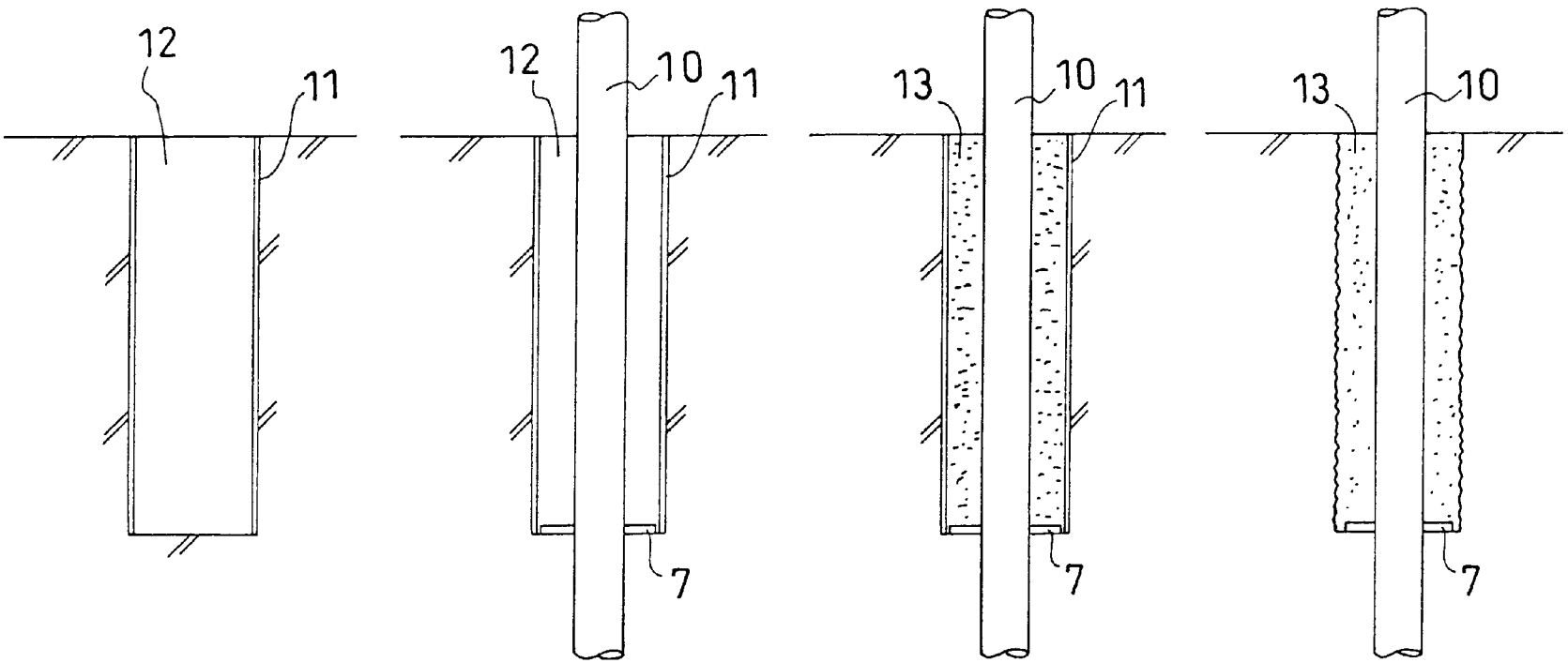
FIGS. 6(*a*)–(*d*) are drawings illustrating an example of an application to protective grids of the frost heave damage preventive structure for underground structures according to the present invention.

FIG. 5 and FIGS. 6(*a*)–(*d*) show examples in which a frost heave damage preventive structure according to the present invention is applied to a pile foundation such as a pile foundation of a pipeline and a pile foundation of a building, etc.

The pile 10, though not specifically limited, is either formed by fixing a reaction member 7 made of a disc-shaped iron plate, etc. on the circumference of an existing steel pipe pile 10 or composed of a concrete pile manufactured by fastening a reaction member 7 made of a disc-shaped iron plate, etc. to a reinforcing member by welding or by means of a screwing member through a connecting member.

To bury the pile 10 under the ground, first a pile hole 12, larger in diameter than the disc-shaped reaction member 7 formed on the pile, is dug or excavated at a position where the pile 10 is to be buried up to the planned position for burying the reaction member 7 (FIG. 6(*a*)).

In that case, if the wall of the pile hole 12 is liable to collapse, it may be all right to use an earth guard 11 such as a casing, stand pipe, etc. of a prescribed length.

For digging the pile hole 12, any optional digging method may be used such as a Beneto method, an earth drill method, a reverse circulation drill method, an earth auger method, etc.

Moreover, to bury the pile 10, it is also possible to dig a pile hole of about the same diameter as the pile 10 deeper than the planned position for burying the reaction member 7 by using the above-mentioned digging methods, as required.

The pile 10 with a disc-shaped reaction member 7 formed on the circumference is driven into the pile hole 12 by using a known pile driver, etc. and the reaction member 7 is placed in contact with the earth at the planned burying position (FIG. 6(*b*)).

The cavity over the reaction member 7 is then back-filled with the back-filling material 13 (FIG. 6(*c*)).

In this case, while the excavated earth may be reused as back-filling material 13, it is more desirable to use soil not easily producing frost heave for reducing the burden on the reaction member 7.

After that, the casing or stand pipe 11 is removed to complete the execution of the work (FIG. 6(*d*)).

As explained in the explanation of the principle of frost heave damage prevention, the pile 10 can be prevented from floating due to a reaction of the reaction member 7 and thereby effectively prevent occurrence of any great damage to the underground structure as the pile 10 lifts in synchronization with the frost heave of the soil 3.

Figure 7:
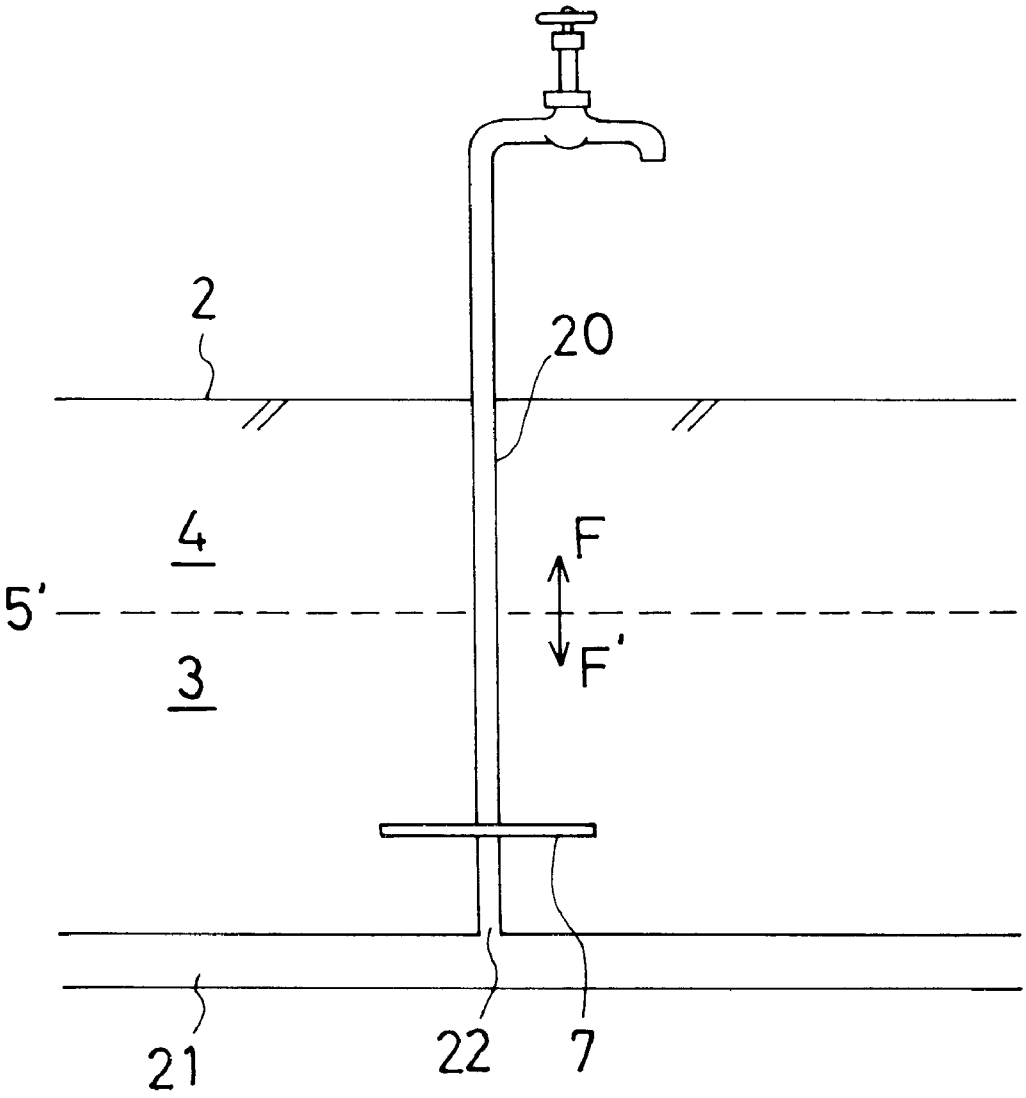
FIG. 7 is a drawing showing an example of an application to a water pipe of the frost heave damage preventive structure according to the present invention.

FIG. 7 shows an example in which the frost heave damage preventive structure according to the present invention is applied to a water pipe which is buried in a vertical orientation.

The water pipe 20 includes an integrally formed plate-like reaction member 7 located below the maximum freezing depth 5' in the particular region (usually 30–100 cm in Hokkaido).

Because the water pipe 20 includes the integrally formed reaction member 7, located below the maximum freezing depth 5', the frost heaving force F acting on the water pipe 20 from the frozen soil layer 4 is balanced, as explained in the explanation of the principle of frost heave damage prevention. The frost heaving reaction force F' acts on the water pipe 20 from the unfrozen soil layer 3 through the reaction member 7, and thus completely prevents any frost heave of the water pipe 20 even if the soil around it is of a type producing frost heave, and thus effectively prevents breaking of the joint 22 between the water main 21 and the water pipe 20.

Explanation has so far been made with reference to examples in which the frost heave damage preventive structure for underground structures according to the present invention is applied to protective grids, foundations of ground structures such as a pile foundation of a pipeline and a pile foundation of a building, etc. and a water pipe. The frost heave damage preventive structure of underground structures according to the present invention can also be widely applied to many different kinds of drainage channel structures such as a U-shaped ditch, etc., pipes buried in a vertical orientation such as gas pipes, etc., a manhole, underground storage houses, underground storage tanks, basements of buildings, etc. constructed in cold regions such as permafrost regions or seasonal freezing regions, etc. and can protect those underground structures against damage due to frost heave and thaw settlement.

What is claimed is:

1. A method of installing a frost heave damage preventive structure in soil having a seasonal freezing layer and a maximum freezing depth, the method comprising:

excavating a pile hole in the soil to a depth below the maximum freezing depth, wherein the excavated pile hole has a predetermined diameter and depth;

inserting a pile into the pile hole, said pile having a plate-like reaction member which projects from an outer circumferential surface of the pile, wherein said reaction member is spaced from a bottom end of the pile and the predetermined diameter of the pile hole is greater than the diameter of the reaction member;

driving the pile into the pile hole so that said reaction member is positioned at the bottom of said excavated pile hole below the maximum freezing depth; and back filling a space over the reaction member between said pile hole and said pile outer surface.

2. The method of installing a frost heave damage preventive structure as claimed in claim 1, wherein said back-filling operation includes filling the space with a material which is different than the material removed during said excavating operation.

3. The method of installing a frost heave damage preventive structure as claimed in claim 2, further comprising:

inserting, prior to insertion of said pile, an earth guard into said pile hole; and removing said earth guard from said pile hole following said back-filling operation.

4. A frost heave damage preventive structure for protecting piles supporting a ground structure, located in a cold region, from damage due to frost heave of soil and thaw settlement, said frost heave damage preventive structure comprising:

a plate-like reaction member provided on a side face of a lower portion of each of the piles, wherein said plate-like reaction member extends approximately in parallel to a freezing front of the ground, and said reaction member is positioned in the ground at a depth which is deeper than a maximum freezing depth of the ground.

5. A frost heave damage preventive structure for protecting piles as claimed in claim 4, wherein each of said piles is a steel pipe pile.

6. The frost heave damage preventive structure as claimed in claim 5, wherein said plate-like reaction member comprises an annular iron plate.

7. A frost heave damage preventive structure for protecting piles as claimed in claim 4, wherein each of said piles is a concrete pipe pile.

8. The frost heave damage preventive structure as claimed in claim 7, wherein said plate-like reaction member comprises an annular iron plate.

9. A method of installing the frost heave damage preventive structure defined in claim 4, the method comprising:

excavating a pile hole which is larger than a planar shape of the plate-like reaction member, wherein the pile hole extends down to a planned buried position of the reaction member;

installing the pile, provided with the reaction member on the side face thereof, in the pile hole; and back filling a void in the pile hole above the reaction member.

* * * * *